US008889248B2

(12) United States Patent
Thiagarajan et al.

(10) Patent No.: US 8,889,248 B2
(45) Date of Patent: Nov. 18, 2014

(54) MULTIWALL SHEET, AN ARTICLE, A METHOD OF MAKING A MULTIWALL SHEET

(75) Inventors: Chinniah Thiagarajan, Karnataka (IN); Frans Adriaansen, Bergen Op Zoom (NL)

(73) Assignee: SABIC Global Technologies B.V. (NL)

( * ) Notice: Subject to any disclaimer, the term of this patent is extended or adjusted under 35 U.S.C. 154(b) by 978 days.

(21) Appl. No.: 12/262,767

(22) Filed: Oct. 31, 2008

(65) Prior Publication Data

US 2010/0112278 A1 May 6, 2010

(51) Int. Cl.
*B32B 3/20* (2006.01)
*B32B 7/00* (2006.01)
*E04C 2/54* (2006.01)

(52) U.S. Cl.
CPC ..... *E04C 2/543* (2013.01)
USPC ..... 428/188; 428/166; 428/119; 428/120

(58) Field of Classification Search
USPC ..... 428/119, 120, 166, 178, 188, 116; 52/793.1, 793.11, 783.1
See application file for complete search history.

(56) References Cited

U.S. PATENT DOCUMENTS 2,662,043 A * 12/1953 Clements ..... 428/120
2,999,835 A 9/1961 Goldberg
3,153,008 A 10/1964 Fox
3,334,154 A 8/1967 Kim
4,001,184 A 1/1977 Scott
4,123,436 A 10/1978 Holub et al.
4,131,575 A 12/1978 Adelmann et al.
4,214,411 A 7/1980 Pickett
4,288,953 A 9/1981 Whiteford
4,351,920 A 9/1982 Ariga et al.
5,154,026 A 10/1992 Strobl, Jr. et al.
5,286,537 A 2/1994 Oita et al.
5,294,472 A 3/1994 Arnold et al.
5,305,564 A 4/1994 Fahey
5,379,557 A 1/1995 Kotter
5,446,634 A 8/1995 Okubo (Continued)

FOREIGN PATENT DOCUMENTS

CN 1521378 A 8/2004
CN 201056790 Y 5/2008

(Continued)

OTHER PUBLICATIONS

Sabic Innovative Plastices, "Lexan* Thermoclear* Plus 2UV Softlite Sheet," Product Data Sheet, 2008, pp. 2 and 6.

(Continued)

*Primary Examiner* — Catherine A Simone
(74) *Attorney, Agent, or Firm* — Cantor Colburn LLP

(57) ABSTRACT

Disclosed herein is a multiwall sheet that comprises a first wall, a second wall, an intermediate wall disposed between the first wall and the second wall, a first set of ribs disposed between the first wall and the intermediate wall, and a second set of ribs disposed between the second wall and the intermediate wall. No ribs are in direct vertical alignment so as to align from the first wall to the second wall and no ribs are on a side of the first wall opposite the intermediate wall or on a side of the second wall opposite the intermediate wall. Also disclosed is a method for making a multiwall sheet.

22 Claims, 5 Drawing Sheets

(56) References Cited

U.S. PATENT DOCUMENTS

| | | | | |
|---|---|---|---|---|
| 5,603,996 | A | 2/1997 | Overcash et al. | |
| 5,765,324 | A | 6/1998 | Schultz | |
| 5,904,019 | A | 5/1999 | Kooij et al. | |
| 5,966,888 | A | 10/1999 | Richardson | |
| 5,972,475 | A | 10/1999 | Beekman | |
| 6,263,624 | B1 | 7/2001 | Hoy et al. | |
| 6,331,028 | B1 | 12/2001 | O'Neill et al. | |
| 6,354,045 | B1 | 3/2002 | Boone et al. | |
| 6,430,893 | B1 | 8/2002 | Kindon | |
| 6,453,633 | B1 | 9/2002 | Wilkinson, Jr. et al. | |
| 6,599,598 | B1 | 7/2003 | Tai et al. | |
| 7,063,126 | B1 * | 6/2006 | Morris | 165/53 |
| 2002/0102390 | A1 | 8/2002 | O'Neill et al. | |
| 2003/0127475 | A1 | 7/2003 | Manini | |
| 2004/0191485 | A1 * | 9/2004 | Groothues et al. | 428/166 |
| 2007/0248792 | A1 * | 10/2007 | Conterno | 428/116 |
| 2009/0148665 | A1 | 6/2009 | Thiagarajan et al. | |
| 2010/0112278 | A1 | 5/2010 | Thiagarajan et al. | |
| 2013/0052429 | A1 | 2/2013 | Thiagarajan et al. | |

FOREIGN PATENT DOCUMENTS

| | | | |
|---|---|---|---|
| DE | 6603591 | | 10/1969 |
| DE | 160977 | | 4/1970 |
| DE | 2800811 | | 7/1979 |
| DE | 10147409 | A1 | 4/2003 |
| EP | 0006231 | A1 | 1/1980 |
| EP | 0283071 | A1 | 9/1988 |
| EP | 0392524 | A1 | 10/1990 |
| EP | 0522541 | B1 | 1/1993 |
| EP | 0530545 | B1 | 3/1993 |
| EP | 0657280 | B1 | 6/1995 |
| EP | 0695840 | B1 | 2/1996 |
| EP | 0705948 | B1 | 4/1996 |
| EP | 0741215 | A1 | 11/1996 |
| EP | 0833015 | B1 | 4/1998 |
| EP | 0892121 | A1 | 1/1999 |
| EP | 0940517 | A1 | 9/1999 |
| EP | 1111153 | A2 | 6/2001 |
| EP | 1184418 | B1 | 3/2002 |
| EP | 2292408 | A1 | 3/2011 |
| WO | 9314277 | A2 | 7/1993 |
| WO | 9620832 | A1 | 7/1996 |
| WO | 9841399 | A1 | 9/1998 |
| WO | 9921712 | A1 | 5/1999 |
| WO | 0238882 | A1 | 5/2002 |
| WO | 0244496 | A1 | 6/2002 |
| WO | 02062566 | A2 | 8/2002 |
| WO | 2005092959 | A1 | 10/2005 |

OTHER PUBLICATIONS

German Patent No. 1609777 (A1); Publication Date: Apr. 30, 1970; Machine Translation; 25 pages.

German Patent No. 2800811 (A1); Publication Date: Jul. 12, 1979; Machine Translation; 31 pages.

German Patent No. 6603591 (U); Publication Date: Oct. 23, 1969; Machine Translation; 20 pages.

International Search Report of the International Searching Authority; International Application No. PCT/IB2009/054735; International Filing Date: Oct. 26, 2009; Date of Mailing: May 2, 2014.

International Preliminary Report and Written Opinion of the International Searching Authority; International Application No. PCT/IB2009/054735; International Filing Date: Oct. 26, 2009; Date of Mailing: May 2, 2014.

Written Opinion of the International Searching Authority; International Application No. PCT/IB2009/054735; International Filing Date: Oct. 26, 2009; Date of Mailing: May 2, 2014.

Chinese Patent No. 1521378 (A); Publication Date: Aug. 18, 2004; Abstract Only; 2 Pages.

Chinese Patent No. 201056790 (Y); Publication Date: May 7, 2008; Abstract Only; 1 Page.

* cited by examiner

MULTIWALL SHEET, AN ARTICLE, A METHOD OF MAKING A MULTIWALL SHEET

BACKGROUND

In the construction of naturally lit structures (e.g., greenhouses, pool enclosures, conservatories, stadiums, sunrooms, and so forth), glass has been employed in many applications as transparent structural elements, such as, windows, facings, and roofs. However, polymer sheeting is replacing glass in many applications due to several notable benefits.

One benefit of polymer sheeting is that it exhibits excellent impact resistance compared to glass. This in turn reduces maintenance costs in applications wherein occasional breakage caused by vandalism, hail, contraction/expansion, and so forth, is encountered. Another benefit of polymer sheeting is a significant reduction in weight compared to glass. This makes polymer sheeting easier to install than glass and reduces the load-bearing requirements of the structure on which they are installed.

In addition to these benefits, one of the most significant advantages of polymer sheeting is that it provides improved insulative properties compared to glass. This characteristic significantly affects the overall market acceptance of polymer sheeting as consumers desire structural elements with improved efficiency to reduce heating and/or cooling costs. It is difficult to design multiwall sheets with a low thermal insulation value (U) because for a given thickness, the air thermal conductivity reaches a saturation point beyond which the increase in the number of walls does not lower the thermal conductivity. Although the insulative properties of polymer sheeting are greater than that of glass, it is challenging to have a low thermal insulation value, high stiffness (i.e., rigidity), and light transmission in polymer sheeting. Thus, there is a continuous demand for further improvement.

SUMMARY

Disclosed herein is a multiwall sheet that comprises a first wall, a second wall, an intermediate wall disposed between the first wall and the second wall, a first set of ribs disposed between the first wall and the intermediate wall, and a second set of ribs disposed between the second wall and the intermediate wall. No ribs are in direct vertical alignment so as to align from the first wall to the second wall and no ribs are on a side of the first wall opposite the intermediate wall or on a side of the second wall opposite the intermediate wall.

In one embodiment a multiwall sheet is disclosed that comprises a first wall, a second wall, intermediate walls disposed between the first wall and the second wall wherein the intermediate walls comprise a first intermediate wall and a second intermediate wall, a first set of ribs disposed between the first wall and a first intermediate wall, and a second set of ribs disposed between the second wall and the second intermediate wall. No ribs are in direct vertical alignment so as to align from the first wall to the second wall and no ribs are on a side of the first wall opposite the intermediate wall or on a side of the second wall opposite the intermediate wall.

In another embodiment, a multiwall sheet is disclosed that comprises a plurality of sheets comprising sets of adjacent walls and a set of ribs disposed between each set of adjacent sheets. The ribs are located in a staggered pattern.

In yet another embodiment, a method of making a multiwall sheet is disclosed. The method comprises forming a first sheet comprising ribs disposed on a wall, forming a second sheet comprising ribs disposed on a wall, and assembling the first and second sheets into a multiwall sheet such that the ribs on the first wall and the ribs on the second wall are not in vertical alignment with one another.

DETAILED DESCRIPTION

Figure 1:
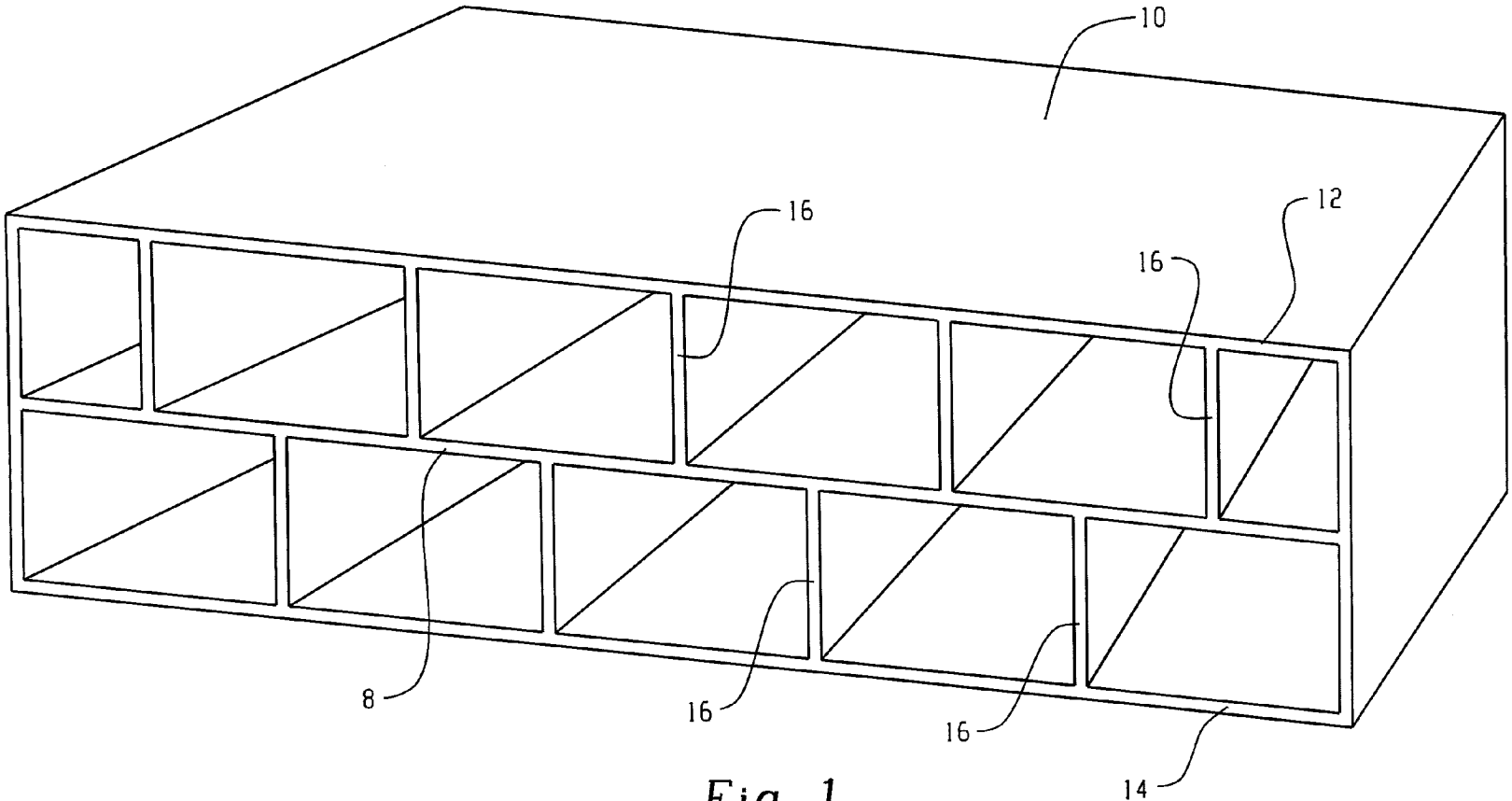
FIG. 1 is an oblique view of an embodiment of a multiwall sheet.

Disclosed herein are multiwall sheets that can offer improved insulated properties, high stiffness, high light transmission, decreased deflection, and decreased stress, e.g., compared to glass. The multiwall sheets of the present application give improved structural, thermal, and optical properties as compared to multiwall sheets without the ribs as described herein for a given sample with an overall sheet thickness. More specifically, multiwall sheets are disclosed herein that comprise ribs disposed upon a wall of the multiwall sheet, where the ribs on each wall are not in direct vertical alignment with one another. Several methods for manufacturing these multiwall sheets are also disclosed.

In some embodiments, the multiwall sheets as disclosed comprise a staggered rib construction, where the ribs present between walls are not in direct vertical alignment with ribs between the subsequent walls such that the ribs extend from the outermost wall of the sheet on one side to the outermost wall of the sheet on the opposite side. Desirably, the present sheets have no vertically aligned ribs that extend from the outermost wall on one side of the sheet to the outermost wall on the opposite side of the sheet. Desirably, the ribs between one wall are off-set from the ribs of a subsequent wall (e.g., not vertically aligned). In some embodiments, no rib is in vertical alignment with a rib disposed between an adjacent layer (e.g., see FIG. 1).

The ribs can be a number of shapes, including staggered, step staggered, diagonal, sinusoidal, and so forth. The multiwall sheets are designed for thermal resistance, flexural rigidity, and optical light transmittance and also for reduced deflection and stress. The multiwall sheets disclosed herein show up to a 30% reduction in the thermal transmittance as well as best in class thermal performance for a given thickness. Thermal performance (e.g., a lower thermal insulation value) is improved with the multiwall sheets as disclosed, having staggered rib, stiffened sheets. The ribs are designed to provide resistance to thermal conductive pathways. Light transmission is also increased with the staggered rib design, even versus diagonal rib designs. Flexural rigidity, and thus, deflection of the multiwall sheet is improved by allowing the middle of the multiwall sheet to transfer loads through the staggered or diagonal rib patterns. The mechanical stiffness of the multiwall sheet is increased by as much as 50% for a given weight and thickness. The rib thickness can be a balance between a thickness that is comparable to the sheet thickness for structural performance and comparable to or less than the sheet thickness for thermal properties.

In one embodiment, a multiwall sheet can comprise a first wall, a second wall, an intermediate wall disposed between the first wall and the second wall, a first set of ribs disposed between the first wall and the intermediate wall, and a second set of ribs disposed between the second wall and the intermediate wall. The ribs of the multiwall sheet are not in direct vertical alignment. That is, the ribs of the multiwall sheet do not align themselves from the first wall to the second wall. In the multiwall sheet, no ribs are present on a side of the first wall opposite the intermediate wall or on a side of the second wall opposite the intermediate wall. In one embodiment, an article comprises the multiwall sheet as described.

In another embodiment, a multiwall sheet comprises a first wall, a second wall and intermediate walls disposed between the first wall and the second wall. The intermediate walls comprise a first intermediate wall and a second intermediate wall. The multiwall sheet also comprises a first set of ribs disposed between a first wall and a first intermediate wall and a second set of ribs disposed between the second wall and the second intermediate wall where no ribs of the multiwall sheet are in direct vertical alignment so that the ribs align from the first wall to the second wall and no ribs are present on a side of the first wall opposite the intermediate wall or on a side of the second wall opposite the intermediate wall. In another embodiment the multiwall sheet can further comprise a third intermediate wall located between the first intermediate wall and the second intermediate wall, a third set of ribs disposed between the first intermediate wall and the third intermediate wall, and a fourth set of ribs disposed between the third intermediate wall and the second intermediate wall. None of the ribs in the first set of ribs are in vertical alignment with any of the ribs of the third set of ribs.

In yet another embodiment, a multiwall sheet comprises a plurality of walls comprising sets of adjacent walls and a set of ribs disposed between each set of adjacent walls, where the ribs are located in a staggered pattern.

In still another embodiment, a method of making a multiwall sheet comprises forming a first wall comprising ribs, forming a second wall comprising ribs, and assembling the first and second wall into a multiwall sheet so that the ribs of the first wall and the ribs of the second wall are not in vertical alignment with one another.

The embodiments can further comprise the ribs being arranged in a stepped pattern or in a diagonal pattern. The embodiments can also comprise the distance between the ribs being less than or equal to 100 millimeters (mm), specifically, 55 mm, more specifically, 32 mm, and still more specifically, 16 mm. The embodiments can still further comprise the sheet thickness being less than or equal to 32 mm. The embodiments can also further comprise the ribs of alternating sets of walls being in vertical alignment. The embodiments can also comprise the equivalent thermal conductivity being less than or equal to 35 W/km·K, specifically less than or equal to 30 W/km·K, more specifically 26 W/km·K.

FIG. 1 illustrates an oblique view of an exemplary multiwall sheet 10. The multiwall sheet comprises a first wall 12, a second wall 14, an intermediate wall 8, and ribs 16 disposed between the first wall 12 and the intermediate wall 8, and between the second wall 14 and the intermediate wall 8. As can be seen from FIG. 1, the ribs 16 disposed between the first wall 12 and the intermediate wall 8 do not correspond to the ribs 16 disposed between the second wall 14 and the intermediate wall 8 (i.e., the ribs are not in direct vertical alignment, they are off-set).

Figure 2:
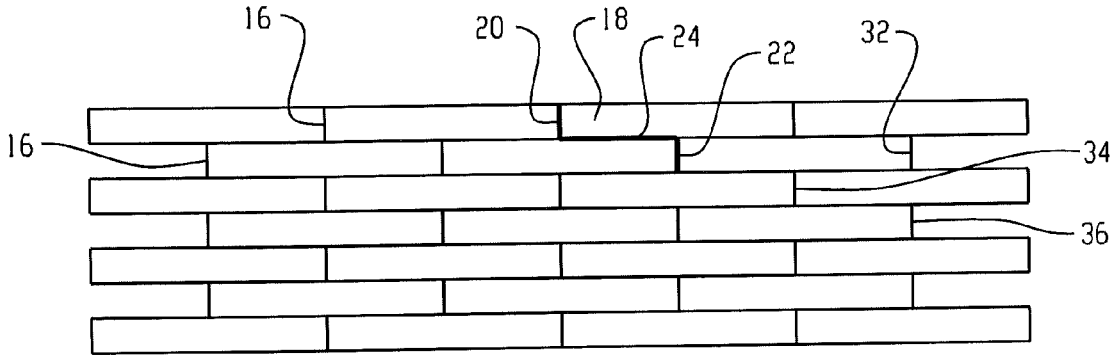
FIG. 2 is a front view of an embodiment of a staggered ribbed multiwall sheet wherein the ribs of alternating sets of sheets are in vertical alignment.
Figure 3:
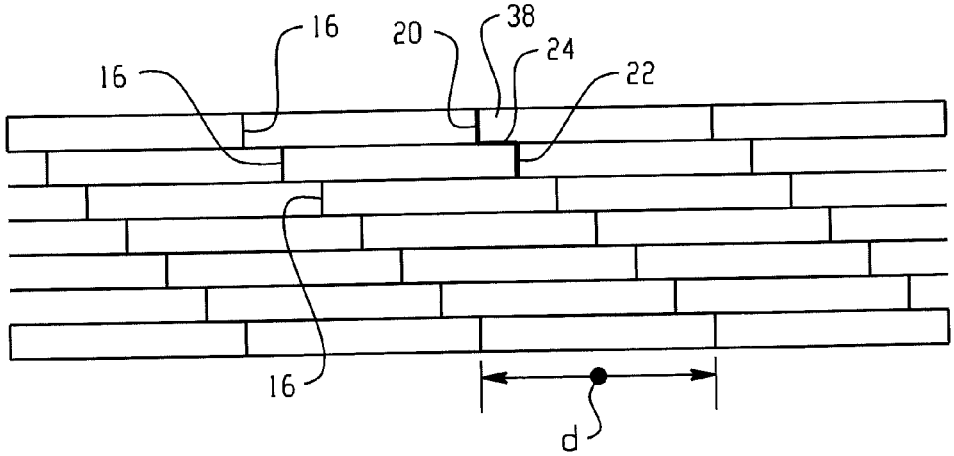
FIG. 3 is a front view of an embodiment of a stepped, staggered ribbed multiwall sheet, wherein none of the ribs are in vertical alignment with subsequent sets of ribs.

FIGS. 2-6 illustrates various embodiments of a multiwall sheet. As can be seen from FIGS. 2-6, the ribs 16 are not in direct, vertical alignment (i.e., the ribs do not form a straight, vertical path from the top to the bottom of the multiwall sheet). FIG. 2 illustrates a front view of an exemplary multiwall sheet. In FIG. 2, the ribs 16 are staggered between each wall, thereby creating steps 18 between each wall. These ribs are disposed such that ribs in adjacent sets of walls are off-set (e.g., 32 and 34, or 34 and 36), while ribs located between alternating sets of walls (e.g., 32 and 36) are in vertical alignment. FIG. 3 illustrates a front view of another exemplary multiwall sheet wherein none of the ribs are in vertical alignment with ribs between other sets of walls. The ribs 16 are staggered in a stepwise manner, also creating steps 38 between each wall. Each step 18, 38 have a riser 20, 22 and a base 24. The height of the riser 20, 22 can be less than or equal to 50% of the length of the base 24 as illustrated in FIG. 2 or the height of the riser 20, 22 can be equal to the length of the base 24 as illustrated in FIG. 3. In one embodiment, each step 18, 38 can be equally divided by the number of walls, or skewed toward the first and/or second wall, or can be spatially distributed across the sheet.

Figure 4:
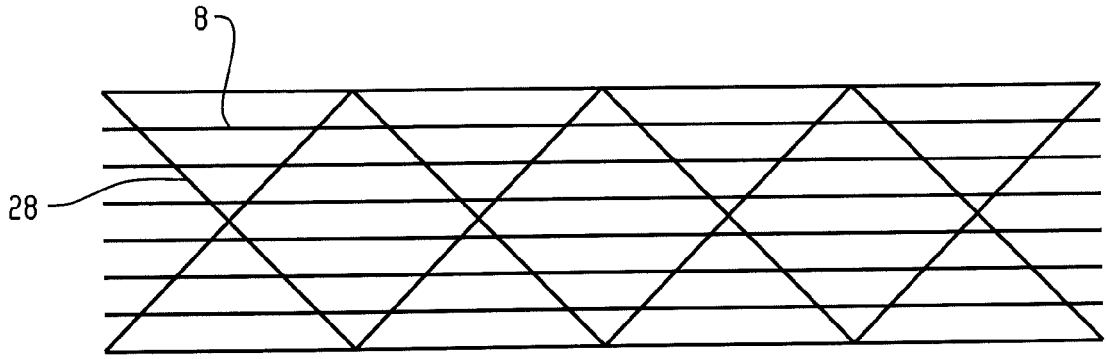
FIG. 4 is a front view of a vertical diagonal ribbed multiwall sheet with horizontal ribs.
Figure 5:
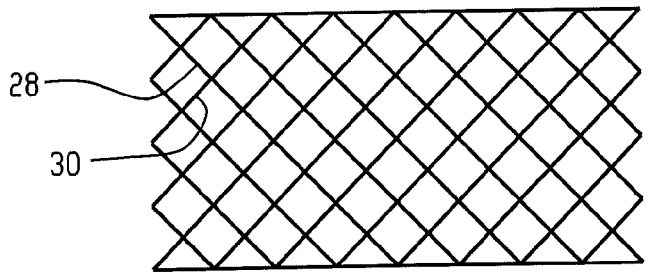
FIG. 5 is a front view of a diagonal multiwall sheet.

FIG. 4 illustrates a front view of still another exemplary multiwall sheet. In FIG. 4, there are intermediate walls 8 and diagonal ribs 28. FIG. 5 illustrates a front view of an exemplary multiwall sheet 10 having diagonal (e.g., diamond shaped) ribs 28, 30. In the embodiment illustrated by FIG. 5, no intermediate wall(s) or vertical ribs are present; only the two outer walls and diagonal ribs are employed.

Not to be bound by theory, it is believed that with the staggered and diagonal rib designs, the heat traveling through the sheet is not given a direct route from the top of the sheet to the bottom of the sheet. The heat must go through each rib disposed in the wall(s) of the multiwall sheet before reaching the bottom of the sheet. Therefore, the sheet is able to dissipate heat as it moves therethrough. This results in a lower thermal insulation (U) value. In addition, the staggered or diagonal rib designs provide increased structural support to the multiwall sheet as compared to vertical aligned ribs. This results in less stress applied to the sheet as well as less deflection.

The multiwall sheet can be formed from polymeric materials, such as thermoplastics and thermoplastic blends. Exemplary thermoplastics include polyalkylenes (e.g., polyethylene, polypropylene, polyalkylene terephthalates (such as polyethylene terephthalate, polybutylene terephthalate)), polycarbonates, acrylics, polyacetals, styrenes (e.g., impact-modified polystyrene, acrylonitrile-butadiene-styrene, styrene-acrylonitrile), poly(meth)acrylates (e.g., polybutyl acrylate, polymethyl methacrylate), polyetherimide, polyurethanes, polyphenylene sulfides, polyvinyl chlorides, polysulfones, polyetherketones, polyether etherketones, polyether ketone ketones, and so forth, as well as combinations comprising at least one of the foregoing. Exemplary thermoplastic blends comprise acrylonitrile-butadiene-styrene/nylon, polycarbonate/acrylonitrile-butadiene-styrene, acrylonitrile butadiene styrene/polyvinyl chloride, polyphenylene ether/polystyrene, polyphenylene ether/nylon, polysulfone/acrylonitrile-butadiene-styrene, polycarbonate/thermoplastic urethane, polycarbonate/polyethylene terephthalate, polycarbonate/polybutylene terephthalate, thermoplastic elastomer alloys, nylon/elastomers, polyester/elastomers, polyethylene terephthalate/polybutylene terephthalate, acetal/elastomer, styrene-maleic anhydride/acrylonitrile-butadiene-styrene, polyether etherketone/polyethersulfone, polyethylene/nylon, polyethylene/polyacetal, and the like.

In one embodiment, a polycarbonate material is employed, such as those designated by the trade name Lexan®, which are commercially available from SABIC Innovative Plastics. Thermoplastic polycarbonate resin that can be employed in producing the plastic sheet includes, without limitation, aromatic polycarbonates, copolymers of an aromatic polycarbonate such as polyester carbonate copolymer, blends thereof, and blends thereof with other polymers depending on the end use application. In another embodiment, the thermoplastic polycarbonate resin is an aromatic homo-polycarbonate resin such as the polycarbonate resins described in U.S. Pat. No. 4,351,920 to Ariga et al.

For example, some possible polycarbonates can be prepared by reacting a dihedral phenol with a carbonate precursor, such as phosgene, a haloformate, or a carbonate ester. Generally, such carbonate polymers comprise recurring structural units of the Formula (I)

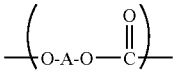

(I)

wherein A is a divalent aromatic radical of the dihydric phenol employed in the polymer producing reaction. In one embodiment, the polycarbonate can have an intrinsic viscosity (as measured in methylene chloride at 25° C.) of about 0.30 to about 1.00 deciliter/gram (dL/g). The dihydric phenols employed to provide such polycarbonates can be mononuclear or polynuclear aromatic compounds, containing as functional groups two hydroxy radicals, each of which is attached directly to a carbon atom of an aromatic nucleus. Possible dihydric phenols include, for example, 2,2-bis(4-hydroxyphenyl)propane (bisphenol A), hydroquinone, resorcinol, 2,2-bis(4-hydroxyphenyl)pentane, 2,4'-(dihydroxydiphenyl)methane, bis(2-hydroxyphenyl)methane, bis(4-hydroxyphenyl)methane, bis(4-hydroxy-5-nitrophenyl)methane, 1,1-bis(4-hydroxyphenyl)ethane, 3,3-bis(4-hydroxyphenyl)pentane, 2,2-dihydroxydiphenyl, 2,6-dihydroxynaphthalene, bis(4-hydroxydiphenyl)sulfone, bis(3,5-diethyl-4-hydroxyphenyl)sulfone, 2,2-bis(3,5-dimethyl-4-hydroxyphenyl)propane, 2,4'-dihydroxydiphenyl sulfone, 5'-chloro-2,4'-dihydroxydiphenyl sulfone, bis(4-hydroxyphenyl)diphenyl sulfone, 4,4'-dihydroxydiphenyl ether, 4,4'-dihydroxy-3,3'-dichlorodiphenyl ether, 4,4-dihydroxy-2,5-dihydroxydiphenyl ether, and the like, and mixtures thereof. Other possible dihydric phenols for use in the preparation of polycarbonate resins are described, for example, in U.S. Pat. No. 2,999,835 to Goldberg, U.S. Pat. No. 3,334,154 to Kim, and U.S. Pat. No. 4,131,575 to Adelmann et al.

The polycarbonate resins can be manufactured by known processes, such as, for example and as mentioned above, by reacting a dihydric phenol with a carbonate precursor, such as phosgene, a haloformate, or a carbonate ester, in accordance with methods set forth in the above-cited literature and in U.S. Pat. No. 4,123,436 to Holub et al., or by transesterification processes such as are disclosed in U.S. Pat. No. 3,153,008 to Fox, as well as other processes.

It is also possible to employ two or more different dihydric phenols or a copolymer of a dihydric phenol with a glycol or with a hydroxy- or acid-terminated polyester or with a dibasic acid in the event a carbonate copolymer or interpolymer rather than a homopolymer is desired. Branched polycarbonates are also useful, such as are described in U.S. Pat. No. 4,001,184 to Scott. Also, there can be utilized combinations of linear polycarbonate and a branched polycarbonate. Moreover, combinations of any of the above materials can be employed to provide the polycarbonate resin.

The polycarbonates can be branched or linear and generally will have a weight average molecular weight (Mw) of 10,000 to 200,000 atomic mass units (AMU), specifically 20,000 to 100,000 AMU as measured by gel permeation chromatography. The polycarbonates disclosed herein can employ a variety of end groups to improve performance, such as bulky mono phenols, including cumyl phenol.

Additives can be employed to modify the performance, properties, or processing of the polymeric material. Exemplary additives comprise antioxidants, such as, organophosphites, for example, tris(nonyl-phenyl)phosphite, tris(2,4-di-t-butylphenyl)phosphite, bis(2,4-di-t-butylphenyl) pentaerythritol diphosphite or distearyl pentaerythritol diphosphite, alkylated monophenols, polyphenols and alkylated reaction products of polyphenols with dienes, such as, for example, tetrakis[methylene(3,5-di-tert-butyl-4-hydroxyhydrocinnamate)]methane, 3,5-di-tert-butyl-4-hydroxyhydrocinnamate octadecyl, 2,4-di-tert-butylphenyl phosphite, butylated reaction products of para-cresol and dicyclopentadiene, alkylated hydroquinones, hydroxylated thiodiphenyl ethers, alkylidene-bisphenols, benzyl compounds, esters of beta-(3,5-di-tert-butyl-4-hydroxyphenyl)-propionic acid with monohydric or polyhydric alcohols, esters of beta-(5-tert-butyl-4-hydroxy-3-methylphenyl)-propionic acid with monohydric or polyhydric alcohols; esters of thioalkyl or thioacyl compounds, such as, for example, distearylthiopropionate, dilaurylthiopropionate, ditridecylthiodipropionate, amides of beta-(3,5-di-tert-butyl-4-hydroxyphenyl)-propionic acid; fillers and reinforcing agents, such as, for example, silicates, fibers, glass fibers (including continuous and chopped fibers), mica and other additives; such as, for example, mold release agents, UV absorbers, stabilizers such as light stabilizers and others, lubricants, plasticizers, pigments, dyes, colorants, anti-static agents, blowing agents, flame retardants, and impact modifiers, among others.

A coating(s) can be disposed on any of the sheet's surfaces to improve the sheet's properties if the coating does not decrease the strength or light transmission of the panel such that the panel is non-operative. Exemplary coatings can comprise antifungal coatings, hydrophobic coatings, hydrophilic coatings, light dispersion coatings, anti-condensation coatings, scratch resistant coatings, and the like, as well as combinations comprising at least one of the foregoing. In one embodiment, the polycarbonate sheet can be coated with a silicone or acrylate hardcoat providing abrasion resistance and solvent resistance to the sheet.

The specific polymer chosen will be capable of providing sufficient light transmission. Specifically, the polymer will be capable of providing a transmittance of greater than or equal to 50%, more specifically, greater than or equal to 70%, and even more specifically, greater than or equal to 85%, as tested per ASTM D-1003-00 (Procedure B, Spectrophotometer, using illuminant C with diffuse illumination with unidirectional viewing).

Transmittance is defined in the following Formula II as:

$$\% T = \left(\frac{I}{I_O}\right) \times 100\% \quad \text{(II)}$$

wherein: I=intensity of the light passing through the test sample

I=Intensity of incident light

In addition to transmittance, the polymeric material can be chosen to exhibit sufficient impact resistance such that the sheet is capable of resisting breakage (e.g., cracking, fracture, and the like) caused by impact (e.g., hail, birds, stones and so forth). Therefore, polymers exhibiting an impact strength greater than or equal to 4.00 Joules per square centimeter ($J/cm^2$), or more specifically, greater than 5.34 $J/cm^2$ or even more specifically, greater than or equal to 6.67 $J/cm^2$ are desirable, as tested per ASTM D-256-93 (Izod Notched Impact Test). Further, desirably, the polymer has ample stiffness to allow for the production of a sheet that can be employed in applications wherein the sheet is generally supported and/or clamped on two or more sides of the sheet (e.g., clamped on all four sides), such as in greenhouse applications comprising tubular steel frame construction. Sufficient stiffness herein is defined as polymers comprising a Young's modulus (e.g., modulus of elasticity) that is greater than or equal to 14,061 kilograms per centimeter squared ($kg/cm^2$), or more specifically, greater than or equal to 17,577 $kg/cm^2$, or even more specifically, greater than or equal to 21,092 $kg/cm^2$.

A multiwall sheet can be formed from polymer processing methods, such as extrusion or injection molding, if produced as a unitary structure. Continuous production methods, such as extrusion, generally offer improved operating efficiencies and greater production rates than non-continuous operations, such as injection molding. Specifically, a single screw extruder can be employed to extrude a polymer melt (e.g., polycarbonate, such as Lexan®, commercially available from SABIC Innovative Plastics). The polymer melt is fed to a profile die capable of forming an extrudate having the cross-section of the multiwall sheet 10 illustrated in FIG. 1. The multiwall sheet 10 travels through a sizing apparatus (e.g., vacuum bath comprising sizing dies) and is then cooled below its glass transition temperature (e.g., for polycarbonate, 297° F. (147° C.)).

After the panel has cooled, it can be cut to the desired length utilizing an extrusion cutter, such as an indexing in-line saw. Once cut, the multiwall sheet can be subjected to secondary operations before packaging. Exemplary secondary operations can comprise annealing, printing, attachment of fastening members, trimming, further assembly operations, and/or any other desirable processes.

Coextrusion methods can also be employed for the production of the multiwall sheet 10. Coextrusion can be employed to supply different polymers to any portion of the multiwall sheet's geometry to improve and/or alter the performance of the panel and/or to reduce raw material costs. In one embodiment, a coextrusion process can be employed to reduce raw material costs by supplying a less expensive polymer to non-structural sections (e.g., foamed or recycled materials). One skilled in the art would readily understand the versatility of the process and the myriad of applications in which coextrusion can be employed in the production of multiwall sheets. The multiwall sheet 10 can also be constructed from multiple components. In multi-component multiwall sheets, the sheet can comprise a multitude of components that can be individually formed from different processes and assembled utilizing a multitude of methods.

The multiwall sheets as disclosed herein have improved thermal, structural, and optical performance. This enables energy savings due to greater efficiency in climate control because of the decreased thermal insulation value. Increased light transmission and stiffness of the multiwall sheet is also achieved with these multiwall sheets. Clarity of the multiwall sheets is improved because of a reduction in the number of ribs present in the sheet and/or complete elimination of vertical continuous ribs. The multiwall sheets disclosed herein with staggered ribs eliminate the solid conduction path, thereby achieving best in class insulation performance. The staggered ribs break the thermal conduction heat transfer path thus giving lower thermal transmittance resistance.

The following non-limiting examples further illustrate the various embodiments described herein.

EXAMPLES

Example 1

Six samples are analyzed using finite element method (FEM) simulations utilizing Abacus® software version 6.7 for performance evaluation. Table 2 displays the dimensions and properties of the samples analyzed, while Table 1 sets forth the test standards. In this example, the thermal insulation value is analyzed for two comparative examples having ribs with direct vertical alignment and four samples having staggered ribs without direct vertical alignment. All samples are Lexan® polycarbonate grade 105. Sample 1 corresponds to FIG. 2, Samples 2 and 5 correspond to FIG. 3, Sample 3 corresponds to FIG. 4, and Sample 4 corresponds to FIG. 5.

The sheet thickness is constant at 16 millimeters (mm), the top/bottom, middle skin, and diagonal thicknesses are also constant at 0.5 mm and 0.1 mm respectively, while the rib thickness varies from 0.1 mm to 0.4 mm. The distance between the ribs was also constant at 16 mm except for Sample 4, which had a distance between ribs of 4 mm. Other constants include the external and internal heat transfer coefficients at 25 Watts per square meter degree Kelvin ($W/m^2K$) and 7.7 $W/m^2K$ respectively and the temperature difference across the sheet at 20 K. The heat flux is measured in Watts per square meter and the thermal insulation (U) value is calculated in $W/m^2K$. The equivalent thermal conductance is calculated by multiplying the thermal insulation (U value) by the thickness to obtain a normalized value. The equivalent thermal conductance is measured in Watts per kilometer degree Kelvin (W/km·K). The following test standards are used in evaluation of the Samples.

TABLE 1

| Standards | | |
|---|---|---|
| Test | Standard | Condition |
| External Heat Transfer Coefficient ($W/m^2K$) | ISO 10077-2:2003 | 25 |
| Internal Heat Transfer Coefficient ($W/m^2K$) | ISO 10077-2:2003 | 7.7 |
| Temperature Difference (degrees Kelvin (K)) | ISO 10077-2:2003 | 20 |
| U Value ($W/m^2K$) | ISO 10077 | ISO 10077-2:2003 |

TABLE 2

| Dimensions and Properties of Samples | | | | | | | |
|---|---|---|---|---|---|---|---|
| Property | A | B | 1 | 2 | 3 | 4 | 5 |
| Total Sheet Thickness (mm) | 16 | 16 | 16 | 16 | 16 | 16 | 16 |
| Top/Bottom Skin Thickness (mm) | 0.5 | 0.5 | 0.5 | 0.5 | 0.5 | 0.5 | 0.5 |
| Middle Skin Thickness (mm) | 0.1 | 0.1 | 0.1 | 0.1 | 0.1 | 0.1 | 0.1 |
| Diagonal Skin Thickness (mm) | 0.1 | 0.1 | 0.1 | 0.1 | 0.1 | 0.1 | 0.1 |
| Rib Thickness (mm) | 0.4 | 0.4 | 0.1 | 0.4 | 0.4 | 0.1 | 0.1 |
| Distance between Ribs (mm)* | 16 | 16 | 16 | 16 | 16 | 4 | 16 |
| External Heat Transfer Coefficient ($W/m^2K$) | 25 | 25 | 25 | 25 | 25 | 25 | 25 |
| Internal Heat Transfer Coefficient ($W/m^2K$) | 7.7 | 7.7 | 7.7 | 7.7 | 7.7 | 7.7 | 7.7 |
| Heat Flux ($W/m^2$) | 35.468 | 34.568 | 32.94 | 34.5 | 33.13 | 36.0 | 33.25 |
| Temperature Difference (K) | 20 | 20 | 20 | 20 | 20 | 20 | 20 |
| U Value ($W/m^2K$) | 2.268 | 2.103 | 1.647 | 1.725 | 1.656 | 1.80 | 1.662 |
| Change in U Value (%) vs. A | N/A | N/A | 27 | 24 | 27 | 21 | 27 |
| Change in U Value (%) vs. B | N/A | N/A | 22 | 18 | 21 | 14 | 21 |
| Avg. Change in U Value (%) | N/A | N/A | 24.5 | 22 | 24 | 17.5 | 24 |
| Equivalent Thermal Conductance (W/km · K) | 36 | 37 | 26 | 28 | 26 | 29 | 27 |

*See "d" in FIG. 3.

As can be seen from Table 2, Comparative Samples A and B both have higher thermal insulation (U values) than Samples 1-5. Without being bound by theory, Applicants believe that heat is able to flow directly from the top of the sheet to the bottom of the sheet, without encountering any resistance to flow in Comparative Samples A and B, thus increasing the U value, while in Samples 1-5, heat encounters resistance in the staggered or diagonal ribs and thus, a lower U value can be achieved. The lowest U values are achieved when the ribs are 0.1 millimeters (mm) thick (Samples 1, 4, and 5). However, Samples 2 and 3, with a rib thickness of 0.4 mm still have lower U values than Comparative Samples A and B (also with a rib thickness of 0.4 mm) by 22 and 24% respectively.

In addition, Samples 1 to 5 each demonstrate that the equivalent thermal conductance decreases with the present rib designs. For a given sheet, equivalent thermal conductance is less than or equal to 35 W/km·K, specifically less than or equal to 30 W/km·K, more specifically less than or equal to 29 W/km·K, still more specifically less than or equal to 28 W/km·K, even more specifically less than or equal to 27 W/km·K, and yet more specifically less than or equal to 26 W/km·K. Applicants unexpectedly found that the equivalent thermal conductance value decreases by 10 units as compared to the samples without the present ribs at the same rib thickness (e.g., see Comparative Sample A with an equivalent thermal conductance of 36 W/km·K and Sample 3 with an equivalent thermal conductance of 26 W/km·K).

Example 2

In this example a multitude of samples are analyzed for stress and deflection. The width of the samples is constant at 980 mm and the loading is also constant at 2500 Newtons per square meter ($N/m^2$). Both fixed and simply supported boundary condition samples are analyzed. Fixed boundary condition refers to a sheet that is clamped on all four sides during the testing, while simply supported boundary condition refers to a generally supported sheet (e.g., supported in the middle of the sheet). A clamped boundary condition uses a rubber gasket to clamp the sheet and gives a performance equal to the average of the fixed and simply supported boundary conditions. Table 3 displays the dimensions for the multiwall sheets analyzed in this Example, while Tables 4-9 display the results from the tests conducted using Abacus® software version 6.7. Tables 4 and 5 display the results when fixed boundary conditions are used for both vertical and staggered ribs. Tables 6 and 7 display the results when simply supported boundary conditions are used for both vertical and staggered ribs. Tables 8 and 9 provide averages for the fixed and simply supported boundary conditions with vertical ribs and for the fixed and simply supported boundary conditions with staggered ribs respectively.

TABLE 3

| Sheet Sample Dimensions | |
|---|---|
| Rib distance | 20 mm |
| Rib thickness | 0.8 mm |
| Sheet Thickness | 32 mm |
| Outer Skin Thickness | 1 mm |
| Inner Skin Thickness | 1 mm |
| Middle Skin Thickness | 0.3 mm |
| Width | 980 mm |

TABLE 4

| Fixed Sheet Samples with Vertical Ribs | | | |
|---|---|---|---|
| Comparative Sample No. | Load ($N/m^2$) | Max Von Mises Stress ($N/mm^2$) | Deflection (mm) |
| C | 250 | 3.981 | 7.799 |
| D | 500 | 6.000 | 11.61 |
| E | 875 | 8.643 | 15.22 |
| F | 1438 | 11.890 | 18.88 |

TABLE 4-continued

| Fixed Sheet Samples with Vertical Ribs | | | |
|---|---|---|---|
| Comparative Sample No. | Load ($N/m^2$) | Max Von Mises Stress ($N/mm^2$) | Deflection (mm) |
| G | 2281 | 15.750 | 22.77 |
| H | 2500 | 16.630 | 23.61 |

TABLE 5

| Fixed Sheet Samples with Staggered Ribs | | | | | |
|---|---|---|---|---|---|
| Comparative Sample No. | Load ($N/m^2$) | Max Von Mises Stress ($N/mm^2$) | Deflection (mm) | % Decrease in Deflection | % Decrease in Stress |
| 5 | 250 | 2.539 | 3.177 | 59 | 36 |
| 6 | 500 | 4.860 | 6.055 | 48 | 19 |
| 7 | 875 | 7.838 | 9.639 | 37 | 9 |
| 8 | 1438 | 11.390 | 13.730 | 27 | 4 |
| 9 | 2281 | 15.440 | 18.170 | 20 | 2 |
| 10 | 2500 | 16.330 | 19.120 | 19 | 2 |

As can be seen from Tables 4 and 5, deflection and stress both decrease with the use of staggered ribs versus vertical ribs. As the load increases, the sheet is stressed to its fullest potential. Table 5 illustrates that as the load is increased to a maximum of 2500 $N/m^2$, the deflection still decreases by nearly 20% in the samples with the staggered ribs.

TABLE 6

| Simply Supported Sheet Samples with Vertical Ribs | | | |
|---|---|---|---|
| Comparative Sample No. | Load ($N/m^2$) | Max Von Mises Stress ($N/mm^2$) | Deflection (mm) |
| I | 250 | 5.582 | 12.99 |
| J | 500 | 11.090 | 25.76 |
| K | 875 | 19.110 | 44.21 |
| L | 1438 | 30.320 | 69.77 |
| M | 2281 | 44.980 | 104.7 |
| N | 2500 | 48.360 | 113.1 |

TABLE 7

| Simply Supported Sheet Samples with Staggered Ribs | | | | | |
|---|---|---|---|---|---|
| Comparative Sample No. | Load ($N/m^2$) | Max Von Mises Stress ($N/mm^2$) | Deflection (mm) | % Decrease in Deflection | % Decrease in Stress |
| 11 | 250 | 2.584 | 5.059 | 59 | 54 |
| 12 | 500 | 5.138 | 10.100 | 61 | 54 |
| 13 | 875 | 8.880 | 17.580 | 60 | 54 |
| 14 | 1438 | 14.660 | 58.570 | 59 | 52 |
| 15 | 2281 | 23.310 | 44.310 | 58 | 48 |
| 16 | 2500 | 25.530 | 48.220 | 57 | 47 |

As can be seen from Tables 6 and 7, both deflection and stress decrease with the use of staggered ribs versus vertical ribs in the samples with the simply supported boundary conditions. Deflection decreases greater than or equal to 60%, specifically greater than or equal to 58%, more specifically greater than or equal to 57%, still more specifically greater than or equal to 55%. Stress also decreases by at least 47% at the highest loading of 2500 $N/m^2$.

TABLE 8

| Average of Fixed and Simply Supported Sheet Samples with Vertical Ribs | | | |
|---|---|---|---|
| Comparative Sample No. | Load ($N/m^2$) | Max Von Mises Stress ($N/mm^2$) | Deflection (mm) |
| O | 250 | 4.782 | 10.3945 |
| P | 500 | 8.545 | 18.685 |
| Q | 875 | 13.877 | 29.715 |
| R | 1438 | 21.105 | 44.325 |
| S | 2281 | 30.365 | 63.735 |
| T | 2500 | 32.495 | 68.355 |

TABLE 9

| Average of Fixed and Simply Supported Sheet Samples with Staggered Ribs | | | | | |
|---|---|---|---|---|---|
| Comparative Sample No. | Load ($N/m^2$) | Max Von Mises Stress ($N/mm^2$) | Deflection (mm) | % Decrease in Deflection | % Decrease in Stress |
| 17 | 250 | 2.562 | 4.118 | 60 | 46 |
| 18 | 500 | 4.999 | 8.078 | 57 | 41 |
| 19 | 875 | 8.359 | 13.610 | 54 | 40 |
| 20 | 1438 | 13.025 | 21.150 | 52 | 27 |
| 21 | 2281 | 19.375 | 31.240 | 51 | 36 |
| 22 | 2500 | 20.930 | 33.670 | 51 | 36 |

As can be seen from Table 9, deflection decreases on average greater than or equal to 60% in the samples where the staggered ribs are present versus the vertical ribs, specifically greater than or equal to 55%, more specifically greater than or equal to 53% and even more specifically greater than or equal to 51%. Stress also decreases with the presence of staggered ribs. On average, stress decreases greater than or equal to 45%, specifically greater than or equal to 40%, more specifically greater than or equal to 35%, still more specifically greater than or equal to 30%, and even more specifically greater than or equal to 25%.

Figure 6:
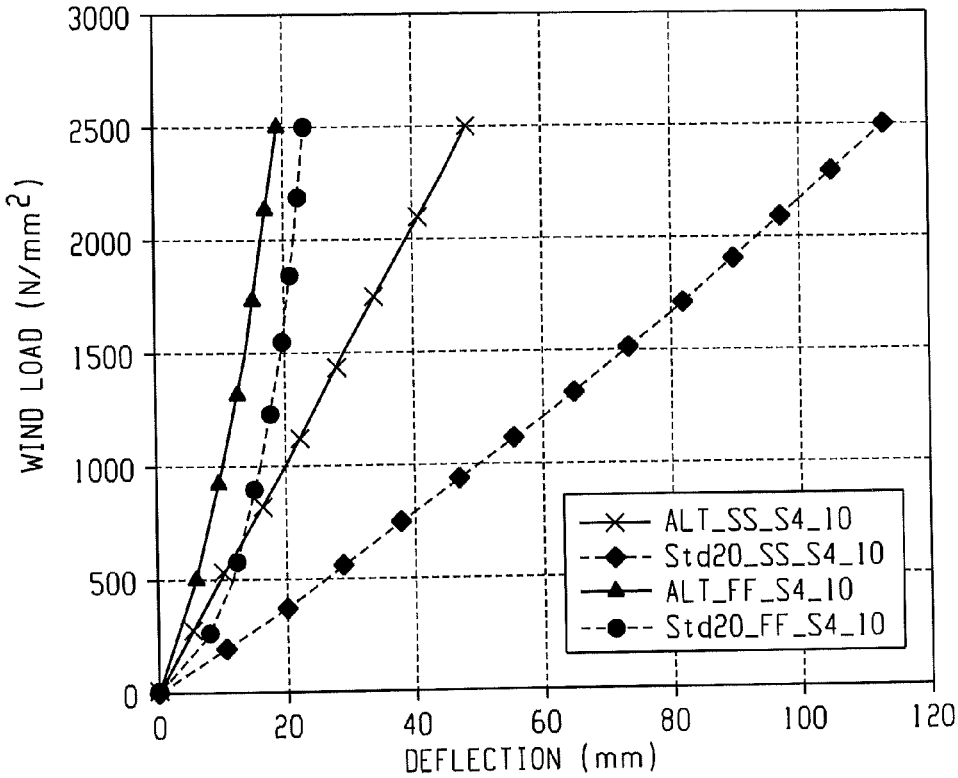
FIG. 6 is a graph illustrating the deflection performance of an embodiment of the multiwall sheet.
Figure 7:
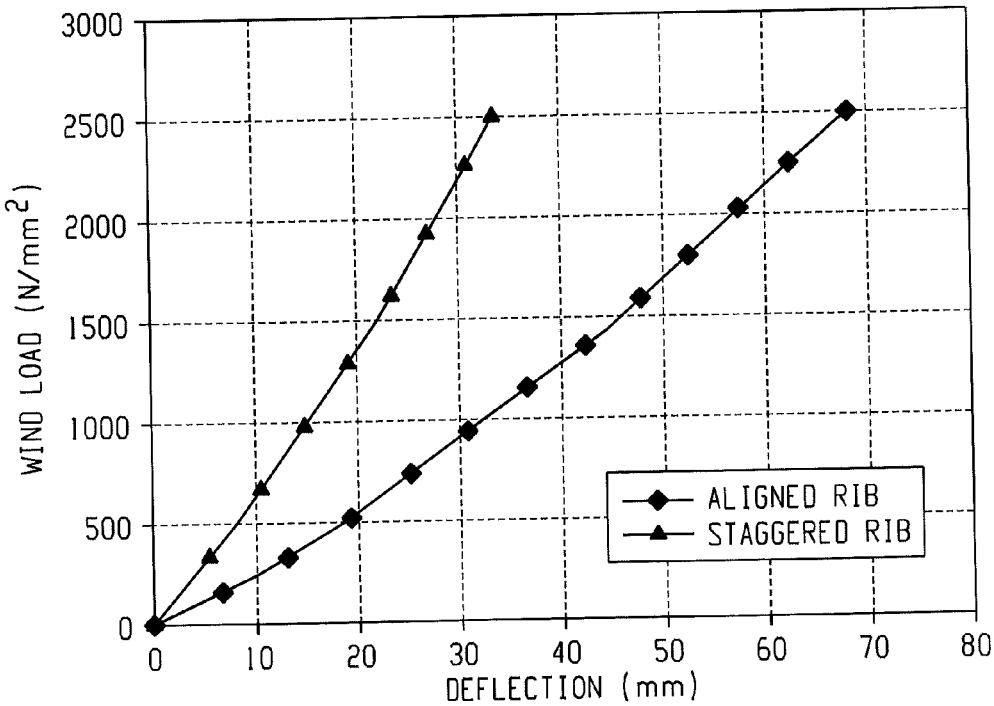
FIG. 7 is a graph illustrating the deflection performance of an embodiment of the multiwall sheet.

FIG. 6 is a graph illustrating the deflection for fixed and simply supported boundary conditions with both vertical and staggered rib constructions. As can be seen from FIG. 6, the deflection decreases in both the fixed and simply supported boundary conditions with the staggered rib design. FIG. 7 is a graph illustrating the average deflection versus the load for both vertical and staggered rib constructions with both fixed and simply supported boundary conditions. As the loading increases to a maximum of 2500 $N/m^2$, the deflection decreases by 53% with the staggered rib construction. A staggered rib design is utilized in these samples, similar to that as illustrated in FIG. 2.

Example 3

In this example, several samples are analyzed for stress and deflection. The width of the samples is constant at 976 mm and the loading is also constant at 2500 $N/m^2$. Both fixed and simply supported boundary condition samples are analyzed. Table 10 displays the dimensions for the multiwall sheets analyzed in this Example, while Table 11 displays the results from the tests conducted. The samples with the staggered ribs are similar to those as shown in FIG. 2. The tests are conducted using finite element method techniques, specifically, Abacus® simulation software.

TABLE 10

| Sheet Sample Dimensions | |
|---|---|
| Rib distance | 16 mm |
| Rib thickness | 0.8 mm |
| Sheet Thickness | 32 mm |
| Outer Skin Thickness | 1 mm |
| Inner Skin Thickness | 1 mm |
| Middle Skin Thickness | 0.3 mm |
| Width | 976 mm |
| Length | 10 m |

TABLE 11

Results from Analysis Conducted with Vertical and Staggered Ribs

| Boundary Condition | Loading ($N/m^2$) | Max Deflection (mm) Vertical Ribs | Max Deflection (mm) Staggered Ribs | Max Von Mises Stress ($N/mm^2$) Vertical Ribs | Max Von Mises Stress ($N/mm^2$) Staggered Ribs | % Decrease in Deflection | % Decrease in Stress |
|---|---|---|---|---|---|---|---|
| Fixed | 2500 | 22.87 | 17.68 | 17.52 | 15.46 | 23 | 12 |
| Simply Supported | 2500 | 90.89 | 42.08 | 39.43 | 19.53 | 54 | 50 |
| Average | 2500 | 56.88 | 29.88 | 28.48 | 17.50 | 47 | 39 |

As can be seen from Table 11, deflection decreases on average almost 50% for the samples with the staggered ribs. For the simply supported Samples, deflection decreases by 54%, while for the fixed Samples, deflection decreases by 23%. Stress also decreases, on average, almost 40% for the samples containing the staggered ribs. With the staggered ribs, membrane action, reduced apparent rib distance, and effective levering of geometric nonlinear effects aid the staggered multiwall sheet in producing less stress and deflection than multiwall sheets with vertical ribs. As the load increases, the geometric nonlinear effects minimize the difference in the stress level. As the load increases, the sheet is stressed to its fullest potential. This demonstrates that the optimal positions of the rib and rib distance can minimize the stress level.

Figure 8:
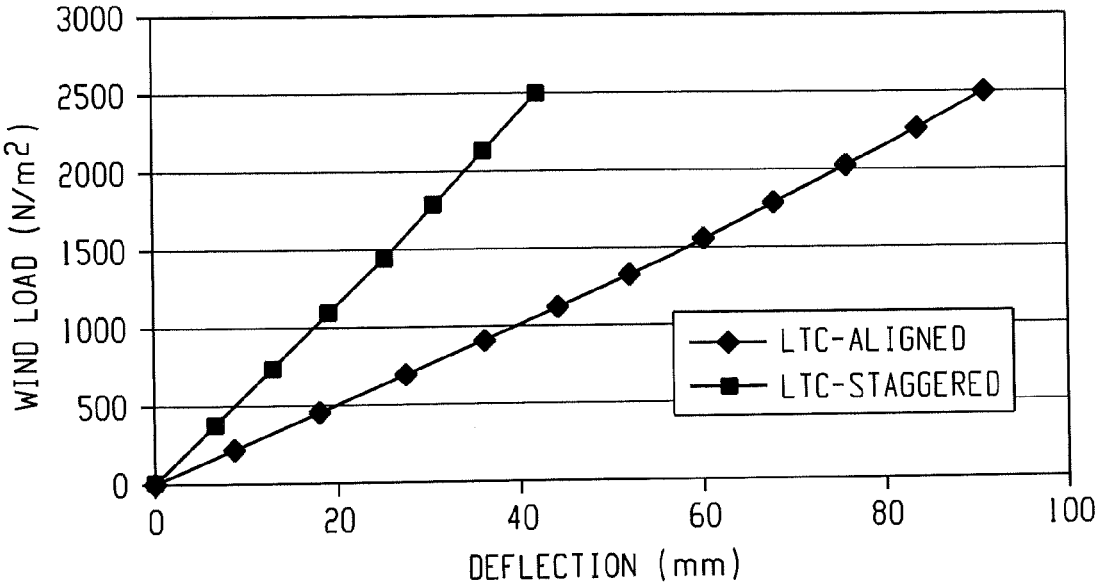
FIG. 8 is a graph illustrating the deflection performance of an embodiment of the multiwall sheet.
Figure 9:
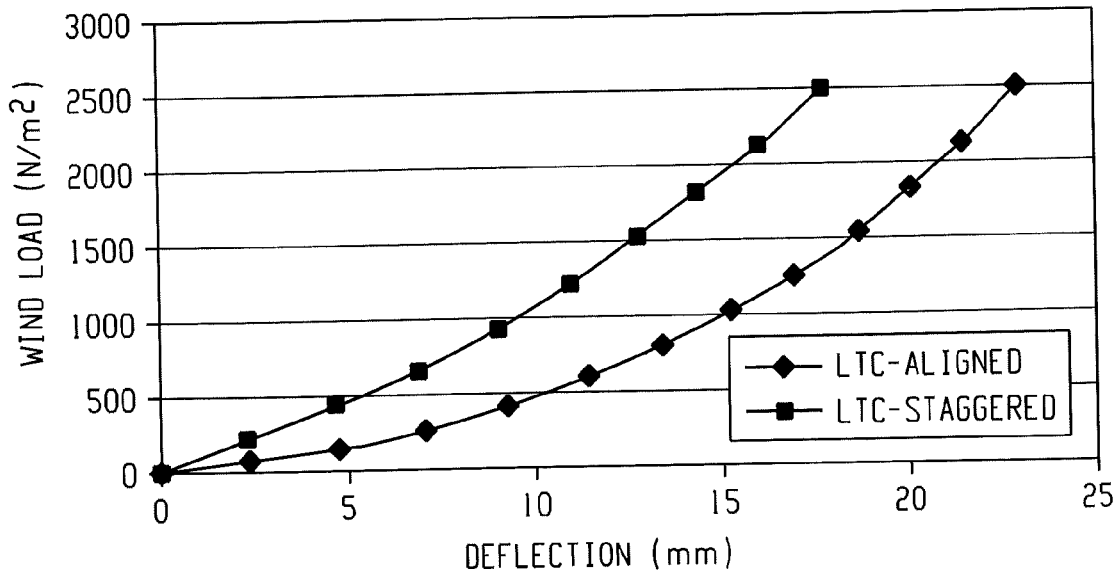
FIG. 9 is a graph illustrating the deflection performance of an embodiment of the multiwall sheet.

FIG. 8 illustrates the load versus the deflection curve when the boundary condition is fixed for vertical and staggered rib designs, while FIG. 9 illustrates the load versus the deflection curve when the boundary condition is simply supported for vertical and staggered rib designs. The staggered rib design utilized is similar to that illustrated in FIG. 2. As can be seen from FIG. 8, the samples with the staggered ribs show less deflection at each loading level. The same can be seen in FIG. 9. In fact, at a loading of 2500 $N/m^2$, the deflection decreased by 56% with the staggered rib construction.

The multiwall sheets of the present application comprise ribs disposed on a wall of the sheet where the ribs on each wall are not in direct vertical alignment (i.e., the ribs extend from a wall of one sheet to a wall of another sheet). The multiwall sheets can advantageously be used in various applications including, but not limited to, greenhouses, pool enclosures, conservatories, stadiums, sunrooms, etc. The multiwall sheets as disclosed herein can be used in applications to replace glass due to their higher insulative properties, higher light transmission and stiffness, lower deflection, and lower stress as compared to glass. The multiwall sheets exhibit increased thermal conductivity evidenced by the lower thermal insulation values compared to multiwall sheets without the ribs as disclosed.

The terms "first," "second," and the like, "primary," "secondary," and the like, as used herein do not denote any order, quantity, or importance, but rather are used to distinguish one element from another. The terms "a" and "an" do not denote a limitation of quantity, but rather denote the presence of at least one of the referenced item. "Optional" or "optionally" means that the subsequently described event or circumstance may or may not occur, and that the description includes instances where the event occurs and instances where it does not.

Unless defined otherwise, technical and scientific terms used herein have the same meaning as is commonly understood by one of skill in the art to which this application belongs. The modifier "about" used in connection with a quantity is inclusive of the stated value and has the meaning dictated by the context (e.g., includes the degree of error associated with measurement of the particular quantity). All cited patents, patent applications, and other references are incorporated herein by reference in their entirety. However, if a term in the present application contradicts or conflicts with a term in the incorporated reference, the term from the present application takes precedence over the conflicting term from the incorporated reference.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A multiwall sheet comprising:

a first wall;

a second wall;

an intermediate wall disposed between the first wall and the second wall;

ribs disposed between the first wall and the intermediate wall and between the second wall and the intermediate wall, wherein at least one of the ribs forms a riser having a height as measured between one wall and an adjacent wall;

a base having a length which extends from one end of the riser across the adjacent wall to a location where a next rib that extends away from the one wall meets the base, and wherein the height of the riser is less than or equal to 50 percent of the length of the base;

wherein no ribs are in direct vertical alignment so as to align from the first wall to the second wall, and wherein there are no ribs on a side of the first wall opposite the intermediate wall or on a side of the second wall opposite the intermediate wall; and wherein the multiwall sheet comprises a polymeric material.

2. The multiwall sheet of claim 1, wherein equivalent thermal conductivity is less than or equal to 35 W/km·K.

3. The multiwall sheet of claim 2, wherein the equivalent thermal conductivity is less than or equal to 30 W/km·K.

4. The multiwall sheet of claim 3, wherein the equivalent thermal conductivity is less than or equal to 26 W/km·K.

5. The multiwall sheet of claim 1, wherein thermal insulation value is less than or equal to 2 $W/m^2K$ at a thickness of 16 mm.

6. The multiwall sheet of claim 1, wherein the distance between the ribs is less than or equal to 100 millimeters (mm).

7. The multiwall sheet of claim 1, wherein the distance between the ribs is less than or equal to 55 millimeters (mm).

8. The multiwall sheet of claim 1, wherein the distance between the ribs is less than or equal to 32 millimeters (mm).

9. The multiwall sheet of claim 1, wherein the distance between the ribs is less than or equal to 16 millimeters (mm).

10. The multiwall sheet of claim 1, wherein the sheet thickness is less than or equal to 32 mm.

11. The multiwall sheet of claim 1, wherein the sheet transmits light.

12. The multiwall sheet of claim 1, wherein the polymer has a transmittance of greater than or equal to 70% as tested per ASTM D-1003-00, Procedure B, Spectrophotometer, using illuminant C with a diffuse illumination with unidirectional viewing.

13. The multiwall sheet of claim 1, wherein the sheet has a thermal insulation value of less than 1.8 $W/m^2K$ at a thickness of 16 mm.

14. An article comprising the multiwall sheet of claim 1.

15. A multiwall sheet comprising:

a first wall;

a second wall;

intermediate walls disposed between the first wall and the second wall, wherein the intermediate walls comprise a first intermediate wall and a second intermediate wall;

first ribs disposed between the first wall and a first intermediate wall, second ribs disposed between the second wall and the second intermediate wall, and intermediate ribs disposed between the intermediate walls, wherein at least one of the ribs forms a riser having a height as measured between one wall and an adjacent wall;

a base having a length which extends from one end of the riser across the adjacent wall to a location where a next rib that extends away from the one wall meets the base, and wherein the height of the riser is less than or equal to 50 percent of the length of the base;

wherein no ribs are in direct vertical alignment so as to align from the first wall to the second wall, and wherein there are no ribs on a side of the first wall opposite the intermediate wall or on a side of the second wall opposite the intermediate wall; and wherein the multiwall sheet comprises a polymeric material.

16. The multiwall sheet of claim 15, further comprising a third intermediate wall located between the first intermediate wall and the second intermediate wall;

third ribs disposed between the first intermediate wall and the third intermediate wall; and fourth ribs disposed between the third intermediate wall and the second intermediate wall;

wherein none of the first ribs are in vertical alignment with any of the third ribs.

17. The multiwall sheet of claim 15, wherein the sheet has a thermal insulation value of less than 1.8 $W/m^2K$ at a thickness of 16 mm.

18. A multiwall sheet comprising:

a plurality of sheets comprising sets of adjacent walls;

ribs disposed between each set of adjacent walls, wherein at least one of the ribs forms a riser having a height as measured between a set of the adjacent walls;

a base having a length which extends from one end of the riser across one of the adjacent walls to a location where a next rib that extends away from the other adjacent wall of the set of adjacent walls meets the base, and wherein the height of the riser is less than or equal to 50 percent of the length of the base;

wherein the ribs are located in a staggered pattern; and wherein the multiwall sheet comprises a polymeric material.

19. The multiwall sheet of claim 18, wherein the ribs are located in a diagonal pattern.

20. The multiwall sheet of claim 18, wherein the ribs of alternating sets of walls are in vertical alignment.

21. The multiwall sheet of claim 18, wherein the sheet has a thermal insulation value of less than 1.8 $W/m^2K$ at a thickness of 16 mm.

22. The multiwall sheet of claim 18, wherein no ribs are in direct vertical alignment.

* * * * *